United States Patent [19]

Lewis et al.

[11] Patent Number: 4,863,019

[45] Date of Patent: Sep. 5, 1989

[54] GOLF BAG LOCK

[76] Inventors: Elmer R. Lewis, 1878 E. Calaveras St., Altadena, Calif. 91001; Allen Smith, 18 Swift Ct., Newport Beach, Calif. 92663

[21] Appl. No.: 206,286

[22] Filed: Jun. 14, 1988

[51] Int. Cl.[4] ..... A63B 55/00; A63B 57/00

[52] U.S. Cl. ..... 206/315.3; 70/19; 70/64

[58] Field of Search ..... 206/315.2–315.8; 150/52 R, 52 G; 323/71; 273/32 E; 24/30.5 R; 70/19, 64; 211/70.2

[56] References Cited

U.S. PATENT DOCUMENTS

| | | | |
|---|---|---|---|
| 1,570,510 | 1/1926 | McQuirk | 206/315.4 |
| 1,717,959 | 6/1929 | Cauffman | 206/315.6 |
| 1,731,588 | 10/1929 | Patterson | 206/315.6 |
| 1,770,060 | 7/1930 | Barlow | 206/315.6 |
| 1,788,478 | 1/1931 | Beaty et al. | 206/315.6 |
| 1,835,632 | 12/1931 | Buhrke | 211/70.2 |
| 1,908,998 | 5/1933 | Mullins | 206/315.4 |
| 1,928,922 | 10/1933 | Adams | 206/315.4 |
| 2,114,870 | 4/1938 | Calkins | 206/315.6 |
| 3,059,861 | 10/1962 | Lorbeski | 206/315.4 |
| 3,909,031 | 9/1975 | Schmaedeke et al. | 280/11.37 |
| 4,042,918 | 8/1977 | Klitzman | 340/280 |
| 4,254,888 | 3/1981 | Chandler | 220/85 P |
| 4,538,728 | 9/1985 | Lewis | 206/315.3 |
| 4,767,001 | 8/1988 | Kim | 206/315.3 |

FOREIGN PATENT DOCUMENTS 2603944 5/1977 Fed. Rep. of Germany ... 206/315.3

*Primary Examiner*—Sue A. Weaver

*Attorney, Agent, or Firm*—Fulwider, Patton, Lee & Utecht

[57] ABSTRACT

The golf bag lock is intended for use in combination with a golf club bag having a mouth portion for receiving golf clubs, and comprises a pair of elongated rigid arm members for gripping one or more golf club shafts therebetween, and a rear mount having a base secured to the golf bag and an extension member hingedly mounted to the base. The arm members are hingedly mounted to the extension member to allow the arm members to swing over and away from the mouth of the golf bag, and a front mount is provided for locking the arm members in place over the golf bag. Two spaced apart posts are also provided on the front mount to form a slotted area into which the ends of the arm members may easily be placed. The front mount also includes a lockring, and the free ends of the arm members have corresponding apertures through which a conventional lock may be placed to lock the arm members to the front mount. A resilient liner is also provided in centrally located recesses in the arm members to allow for firm protective gripping of the golf club shafts.

18 Claims, 4 Drawing Sheets

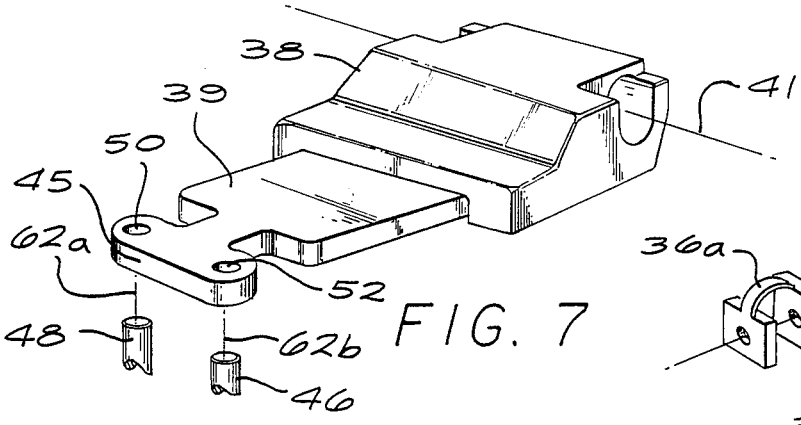
FIG. 7
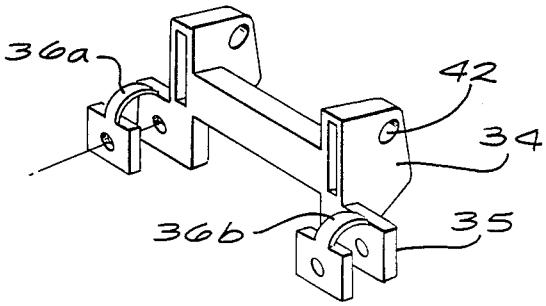
FIG. 8
FIG. 9
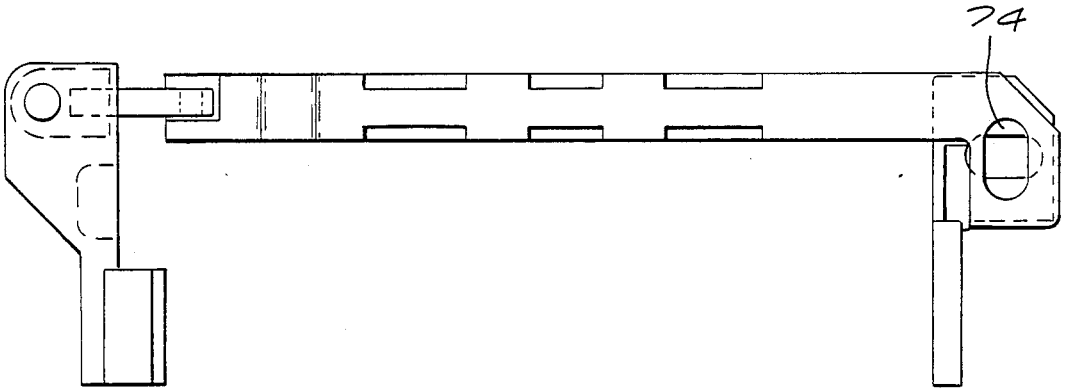
FIG. 10
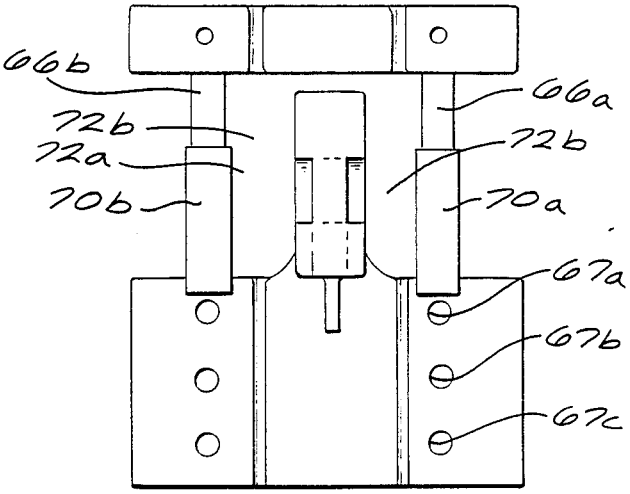
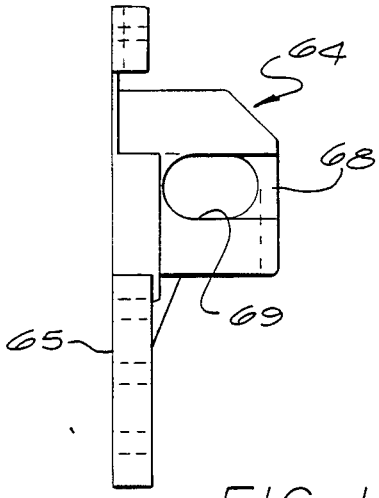
FIG. 11

GOLF BAG LOCK

BACKGROUND OF THE INVENTION

1. Field of the Invention:

This invention is directed to a security device for use in combination with a golf club bag, for the purpose of locking golf clubs within the bag to prevent theft of the golf clubs. More particularly, the golf bag lock of the invention comprises two elongated arm members with a recess therebetween for receiving the shafts of the golf clubs. The two arm members are to be mounted on the top of a club bag and can be locked together to prevent removal of the golf clubs from the bag.

2. Prior Art:

It is unfortunately not an uncommon experience for golf clubs to be stolen out of unattended club bags at golf courses or country clubs. Various types of covers have been designed to fit over the mouth of the club bag to completely envelop the golf clubs within the bag, or to provide an opening for one or more shafts of the golf clubs which is large enough to accommodate one or more golf club shafts, but not large enough to permit the removal of the golf clubs, in a locked or closed configuration. Various covers are known from U.S. Pat. Nos. 1,570,510 (McQuirk); 1,928,922 (Adams); and 1,908,998 (Mullens). Such devices are generally made of a material which can be cut open to allow quick removal of the golf clubs. Covers for golf bags having a plurality of holes through which individual golf club shafts may extend are known from U.S. Pat. No. 1,717,959 (Cauffman), and 1,770,060 (Barlow) of which the later prevents removal of the golf clubs when the heads of the golf clubs are placed down within the bag. Use of that security device requires the inconvenience of turning the golf clubs upside down. U.S. Pat. No. 1,717,959 discloses a golf bag cover with a rotating disk made of metal, having uniformly sized holes, which can clamp the golf club shafts in place to prevent removal of the golf clubs. The metal of the cover and the uniform size of the holes allows the finish of the shafts of some of the clubs to be marred or cut, while others may be loosely held, depending upon the width of the shafts. My U.S. Pat. No. 4,538,728 discloses a cover for the top of a golf club bag, made of two semicircular shells having a padded opening in the middle for firmly retaining golf clubs between the two half shells without marring or cutting the golf club shafts. However, the shells cover the entire upper opening of the golf club bag, preventing the placement of any items within the bag when the cover is closed, and adding to the weight and unweildiness of the golf bag cover. Furthermore, the two half shells need to be carefully aligned over the retaining pins which protrude from the sides of the mouth of the golf bag, and need to be held firmly in a closed position, against the pressure of the compression pad about the golf club shafts, while a separate lock is being applied to keep the two half shells together in position on the top of the golf bag. Another drawback of that cover is that the cover completely separates from the mouth of the golf bag in an open position, and needs to be stored away on the bottom of the bag or hung by a chain from the side of the bag. Although that security device is functional, there is a need for a lighter weight security device which could be placed about the golf clubs with one hand while a conventional lock is applied with the other hand, for ease of use. It would also be useful to provide a design for a golf bag lock which could fit a variety of sizes of golf club bags, without the necessity for custom fitting the dimensions of the security device in order to assure a good fit. There is also a need for a golf bag lock which can be permanently affixed to the top of the golf bag and merely swung into or out of position over the top of the golf bag, to lock or unlock the golf clubs in place. The present invention fulfills these needs.

SUMMARY OF THE INVENTION

This invention is directed to a golf bag lock for locking golf clubs within a golf bag, to prevent theft of the golf clubs from the bag.

Briefly and in general terms, a golf bag lock according to the invention is intended for use in combination with a golf club bag having a mouth portion for receiving golf clubs, and comprises a pair of elongated rigid arm members for gripping one or more golf club shafts therebetween, and a rear mount having a base secured to the golf bag and an extension member hingedly mounted to the base. The arm members are hingedly mounted to the extension member to allow the arm members to swing over and away from the mouth of the golf bag, and a front mount is provided for locking the arm members in place over the golf bag. Two spaced apart posts are also provided on the front mount to form a slotted area into which the ends of the arm members may easily be placed. The front mount also includes a lockring and the free ends of the arm members have corresponding apertures through which a conventional lock may be placed to lock the arm members to the front mount. A resilient liner is also provided in centrally located recesses in the arm members to allow for firm protective gripping of the golf club shafts.

Other aspects and advantages of the invention will become apparent from the following detailed description, and the accompanying drawings, illustrating by way of example the features of the invention.

BRIEF DESCRIPTION OF THE DRAWINGS

FIG. 7 is a front perspective view of the swivel member of the rear mount;

FIG. 8 is a perspective view of the base portion of the rear mount;

FIG. 9 is a side elevational view of an alternate embodiment of the golf bag lock;

FIG. 10 is a front elevational view of the front mount;

FIG. 11 is a side elevational view of the front mount;

DETAILED DESCRIPTION OF THE EMBODIMENT

Figure 1:
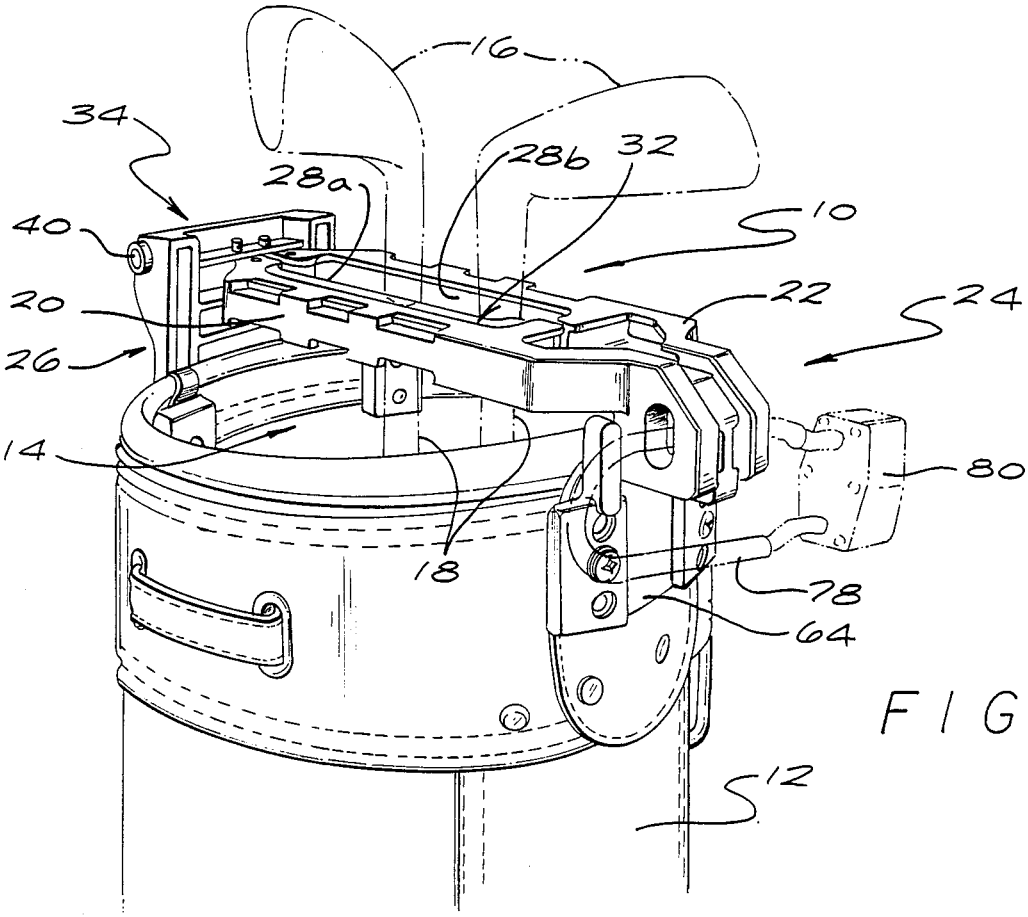
FIG. 1 is a front perspective of the golf bag lock mounted on a golf bag.
Figure 2:
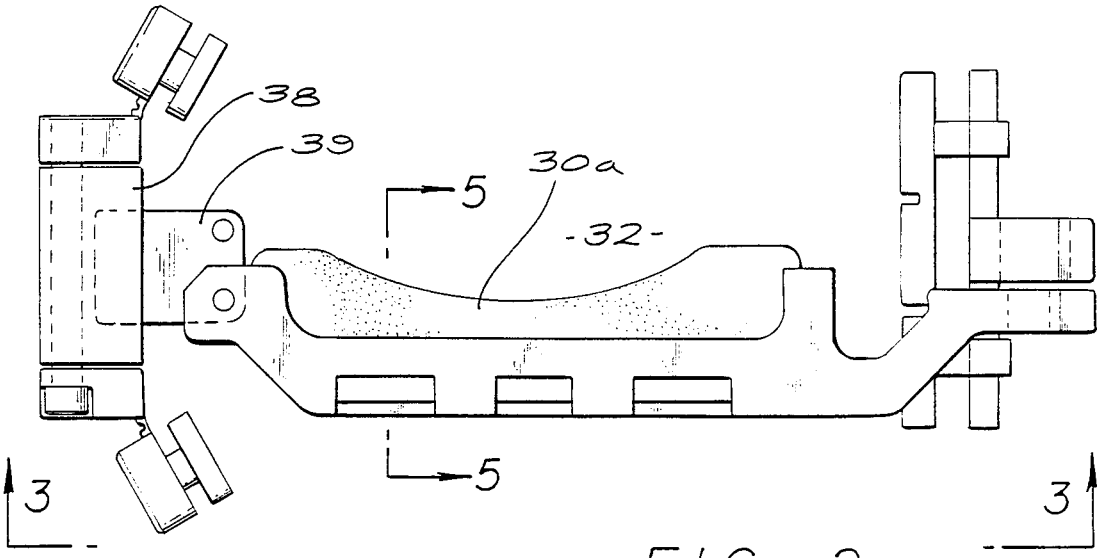
FIG. 2 is top plan view showing the golf bag lock with one of the arm members removed.
Figure 3:
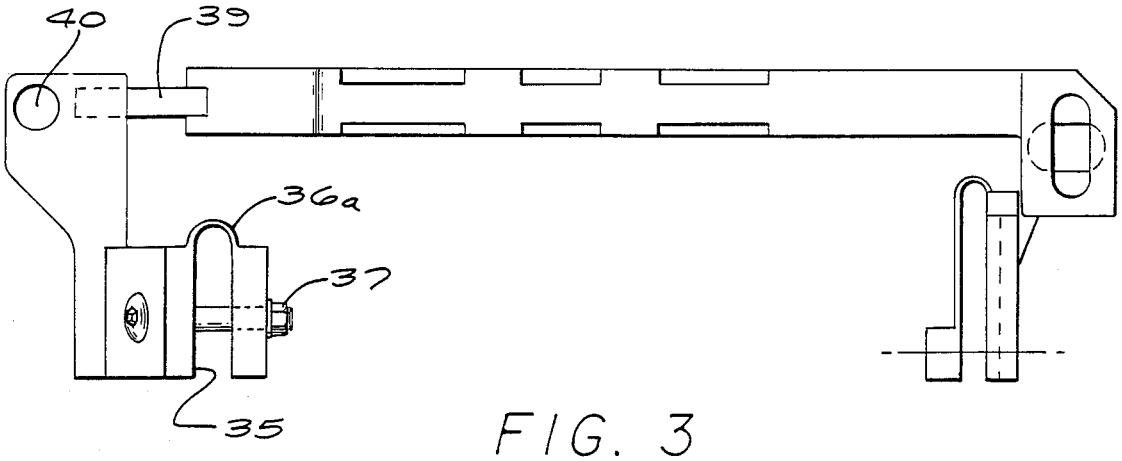
FIG. 3 is a side elevational view of the golf bag lock taken along lines 3—3 of FIG. 2.
Figure 4:
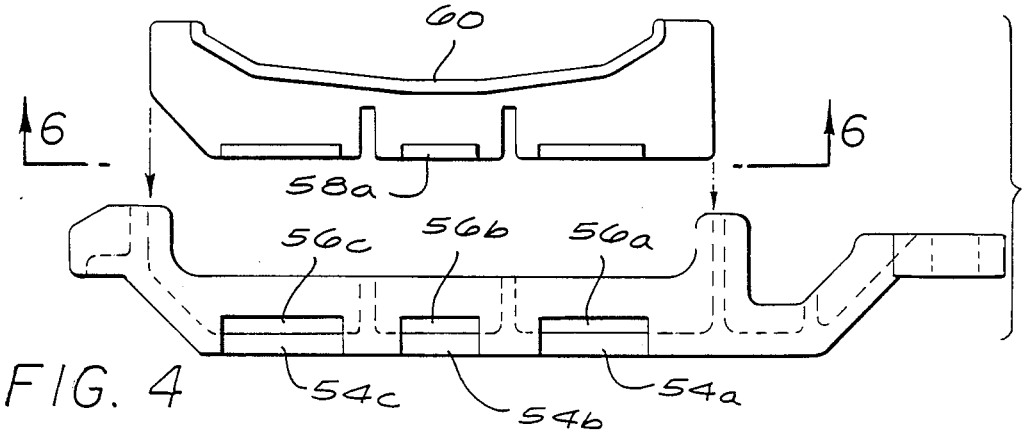
FIG. 4 is a break away view of a top plan view of one of the arm members.
Figure 5:
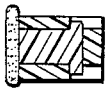
FIG. 5 is a sectional view of an arm member taken along lines 5—5 of FIG. 2.
Figure 6:
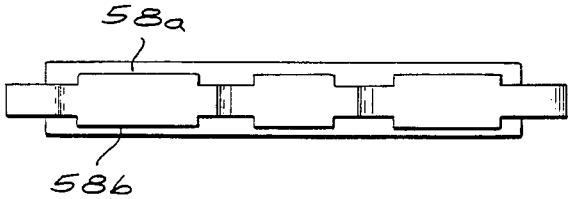
FIG. 6 is a side elevational view of a liner member taken along lines 6—6 of FIG. 4.
Figure 12:
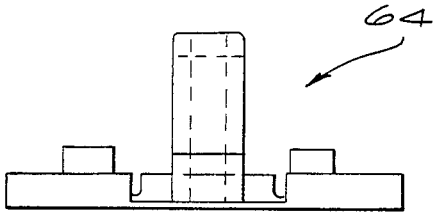
FIG. 12 is a top plan view of an alternate embodiment of the front mount.
Figure 13:
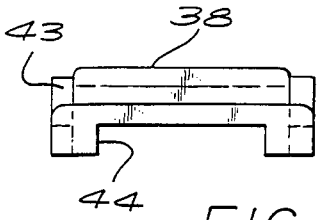
FIG. 13 is a front elevational view of an alternate embodiment of a swivel member of the rear mount.
Figure 14:
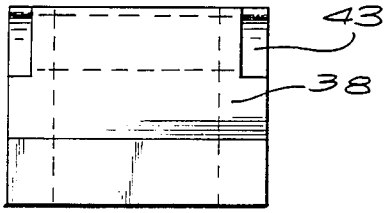
FIG. 14 is a top plan view of the swivel portion of FIG. 13.
Figure 15:
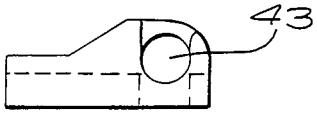
FIG. 15 is a side elevational view of the swivel portion of FIG. 13.
Figure 16:
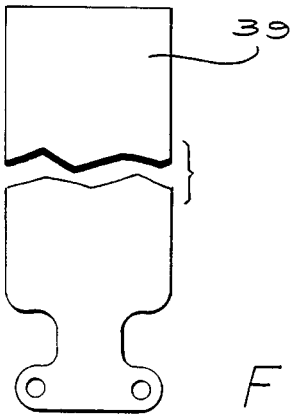
FIG. 16 is a top plan view of an adjustable tongue piece of the adjustable swivel of FIG. 13.

As is shown in the drawings for purposes of illustration, the invention is embodied in a golf bag lock having a pair of elongated rigid arm members for gripping golf club shafts in a central recess area of the arm members, the arm members being mounted on a rear swivel mount, the arm members being hinged on the rear mount to open and close about the golf club shafts. A front mount is also provided for receiving and locking the arm members in position about the shafts of the golf clubs.

In accordance with the invention, there is provided a security device for use in combination with a golf club bag having a mouth portion for receiving at least one golf club shaft, the device comprising first and second elongated rigid arm members for gripping at least one said golf club shaft, at least one of said arm members having a surface defining a central recess such that when said arm members are aligned adjacent one another said central recess area forms an opening sufficient to contain at least one said golf club shaft; mounting means including a base secured to the mouth portion and an extension member hingedly mounted to the base for rotation about a main axis parallel to a plane intersecting said mouth portion; first and second hinge means for securing said first ends of said respective first and second arm members to said extension member for rotation of said first ends about first and second axes each of which is perpendicular to said main axis of rotation; front mounting means including a front mount base secured to the mouth portion opposite the rear mounting means and means on the front mounting base retaining said second ends of said arm members on said front mount base.

As is shown in the drawings, a security device 10 or golf bag lock for a golf bag 12, having a mouth portion 14 at the top for receiving a set of golf clubs 16, is designed to be mounted on the top or mouth portion of the golf bag. The golf club shafts are received between the rigid elongated arm members 20 and 22, which are preferably composed of a lightweight metal, such as aluminum, or a tough plastic which could resist tampering. For purposes of description, the golf bag has a front end 24 and a rear end 26, and the elongated arm members have corresponding front and rear ends. The arm members have central recess areas 28*a* and 28*b* to which is attached is a resilient liner material or pad 30*a*, 30*b* preferably composed of nylon. When the arms are aligned adjacent to each other in a locking position, the central recesses define an opening 32 in which the shafts of the set of golf clubs can be gripped securely, to prevent removal therefrom.

The arm members of the golf bag lock are attached to the rear of the golf bag in a fashion allowing the arms to swing apart and away from the front end of the golf bag, at the rear mount 34. The rear mount is similarly constructed of lightweight aluminum or a tough plastic, so as to the be able to resist tampering. The rear mount includes a base portion 35, preferably having a connector portion 36*a*, 36*b* designed to extend over a portion of the mouth portion to allow for convenient mounting of the base portion on the golf bag. The base portion is preferably secured to the golf bag by bolts or screws 37 extending from one part of the base portion to the other on either side of the golf bag material. The rear mount also includes a hinge member 38 having a tongue member 39 which is preferably integrally formed with the hinge member. The tongue member may be made of various sizes to allow the arm members to accommodate golf bags of various sizes. The hinge member is allowed to swivel about a horizontal axis of the base portion of the rear mount, being connected to the base portion by a bolt 40 having the horizontal axis 41, which is a main axis of rotation for the arm members. The bolt is journaled in the bolt holes 42 of the base portion and the bolt hole 43 of the hinge member.

In an alternative embodiment, the tongue member 39 is also slidable within a slot 44 of the hinge member to allow for adjustments of a one size fits all form of the golf bag lock. At the end of the tongue member 45, hinge pins 46 and 48 are preferably mounted for rotatably securing the rear ends of the arm members. The end of the tongue member contains apertures 50 and 52 through which the hinge pins are journaled.

Each elongated arm member includes cutout portions 54*a, b* and *c* opposed the interior central recess, to provide for lighting of the weight of the arm members, and also to provide for openings 56*a, b* and *c* for receiving the upper and lower tabs 58*a*, 58*b* on the liner, to permit the liner to be inserted and secured by a snap fit in the arm members. The liners also include a flat, smooth surface 60, to prevent marring of the golf club shafts as the shafts are gripped between the arm members.

The hinge pins of the tongue member lie along axes 62*a* and 62*b* perpendicular to the tongue member, to allow for rotation of the arm members in gripping and releasing the golf club shafts from the golf bag lock. When the arm members are aligned adjacent to each other, the front ends of the arm members may be inserted in the front mount 64, having base portion 65, and preferably connector portions 66*a*, 66*b* designed fit over the top of the mouth portion of the golf bag. The base portion of the front mount preferably is in two pieces connected by the connectors 66*a*, 66*b* and these are attached to the golf bag material by screws 67*a, b* , and *c* or bolts. The front mount includes a lockring 68 having a central aperture 69 intended to accept a conventional lock. The base portion of the front mount also includes post members 70*a* and 70*b*, to define slotted portions 72*a*, 72*b* on either side of the central lockring for receiving the front ends of the arm members. Thus, a single individual may be able to place one arm member in its corresponding slotted area, and grasping the golf club shafts to place them in the slotted area with one hand, with the other hand the other arm member may be similarly placed in the corresponding slotted area to secure the golf clubs between the two arm members. The arm members include in their front ends an aperature 74 and 76, also for receiving a lockpin 78 of a conventional padlock 80, when the front ends of the arm members are in position aligning their apertures with the central aperture of the lockring.

In the foregoing description, it has been demonstrated that the club bag lock of the present invention may be made of lightweight materials and conveniently handled by a single individual. The golf bag lock also conveniently swings into and out of position about its permanently mounting on the mouth of the golf bag. It is significant that the arm members of the club bag lock can be rotated into and out of position by a single individual and inserted into the slotted areas provided at the front mount for convenient locking of the golf bag shaft in the golf bag.

From the foregoing it will be appreciated that the golf bag security device provides a simple to use, lightweight, and effective deterrent to theft of golf clubs from golf bags, which adds little discomfort or inconvenience to the golfer, which allows access to other portions of the interior of the golf bag, and which is easily installed.

Although one specific embodiment of the invention has been described and illustrated, it is clear that it is susceptible to numerous modifications and embodiments within the ability of those skilled in the art and without the exercise of the inventive faculty. Thus, it should be understood that various changes in form, detail and application of the present invention may be made without departing from the spirit and scope of this invention.

We claim:

1. A security device for use in combination with a golf club bag having a mouth portion for receiving at least one golf club shaft, said device comprising:

(a) first and second elongated rigid arm members each having first and second ends for gripping at least one said golf club shaft, at least one of said arm members having a surface defining at least one central recess such that when said arm members are aligned adjacent one another said at least one central recess area forms an opening sufficient to contain at least one said golf club shaft;

(b) rear mounting means including a base secured to said mouth portion and an extension member hingedly mounted to said base for rotation about a main axis parallel to a plane intersecting said mouth portion;

(c) first and second hinge means for securing said first ends of said respective first and second arm members to said extension member for rotation of said first ends about first and second axes respectively, each of which is perpendicular to said main axis of rotation;

(d) front mounting means including a front mount base secured to said mouth portion opposite said rear mounting means and means on said front mount base for retaining said second ends of said arm members on said front mount base.

2. The security device of claim 1, wherein said means for retaining said second ends of said arm members on said front mount base comprises first and second spaced apart posts on said front mount base extending away from said golf club bag in a direction perpendicular to the plane of said mouth portion, said posts forming a slotted area therebetween in combination with said front mount base for receiving said second ends of said arm members.

3. The security device of claim 2, said front mounting means having a surface defining a lock mounting means aperture and said second ends of said arm members each having surfaces defining an aperture corresponding to and adapted to be aligned with said lock mounting means aperture when said arm members are received in said slotted area, whereby said apertures when aligned are adapted to receive a lock pin therethrough.

4. The security device of claim 1, wherein each of said first and second arm members have a surface defining a recess, said recesses in said arm members defining said opening therebetween when said arm members are aligned adjacent one another.

5. The security device of claim 4, wherein each of said recesses contain a resilient liner surrounding said opening formed by said recesses when said arm members are aligned adjacent one another.

6. The security device of claim 5, wherein each said resilient liner is comprised of nylon.

7. A golf club bag having a mouth portion for receiving at least one golf club shaft, and means for securing said at least one golf club shaft in said mouth portion, comprising in combination:

(a) first and second elongated rigid arm members each having first and second ends for gripping at least one said golf club shaft, at least one of said arm members having a surface defining at least one central recess such that when said arm members are aligned adjacent one another said at least one central recess area forms an opening sufficient to contain at least one said golf club shaft;

(b) rear mounting means including a base secured to said mouth portion and an extension member hingedly mounted to said base for rotation about a main axis parallel to a plane intersecting said mouth portion;

(c) first and second hinge means for securing said first ends of said respective first and second arm members to said extension member for rotation of said first ends about first and second axes respectively, each of which is perpendicular to said main axis of rotation;

(d) front mounting means including a front mount base secured to said mouth portion opposite said rear mounting means and means on said front mount base for retaining said second ends of said arm members on said front mount base.

8. The golf club bag of claim 7, wherein said means for retaining said second ends of said arm members on said front mount base comprises first and second spaced apart posts on said front mount base extending away from said golf club bag in a direction perpendicular to the plane of said mouth portion, said posts forming a slotted area therebetween in combination with said front mount base for receiving said second ends of said arm members.

9. The golf club bag of claim 8, said front mounting means having a surface defining a lock mounting means aperture and said second ends of said arm members each having surfaces defining an aperture corresponding to and adapted to be aligned with said lock mounting means aperture when said arm members are received in said slotted area, whereby said apertures when aligned are adapted to receive a lock pin therethrough.

10. The golf club bag of claim 7, wherein each of said first and second arm members have a surface defining a recess, said recesses in said arm members defining said opening therebetween when said arm members are aligned adjacent one another.

11. The golf club bag of claim 10, wherein each of said recesses contain a resilient liner surrounding said opening formed by said recesses when said arm members are aligned adjacent one another.

12. The golf club bag of claim 11, wherein each said resilient liner is comprised of nylon.

13. In a golf club bag having a mouth portion for receiving at least one golf club shaft, the improvement comprising:

(a) first and second elongated rigid arm members each having first and second ends for gripping at least one said golf club shaft, at least one of said arm members having a surface defining at least one central recess such that when said arm members are aligned adjacent one another said at least one central recess area forms an opening sufficient to contain at least one said golf club shaft;

(b) rear mounting means including a base secured to said mouth portion and an extension member hingedly mounted to said base for rotation about a main axis parallel to a plane intersecting said mouth portion;

(c) first and second hinge means for securing said first ends of said respective first and second arm members to said extension member for rotation of said first ends about first and second axes respectively, each of which is perpendicular to said main axis of rotation;

(d) front mounting means including a front mount base secured to said mouth portion opposite said rear mounting means and means on said front mount base for retaining said second ends of said arm members on said front mount base.

14. The improved golf club bag of claim 13, wherein said means for retaining said second ends of said arm members on said front mount base comprise first and second spaced apart posts on said front mount base extending away from said golf club bag in a direction perpendicular to the plane of said mouth portion, said posts forming a slotted area therebetween in combination with said front mount base for receiving said second ends of said arm members.

15. The improved golf club bag of claim 14, said front mounting means having a surface defining a lock mounting means aperture and said second ends of said arm members each having surfaces defining an aperture corresponding to and adapted to be aligned with said lock mounting means aperture when said arm members are received in said slotted area, whereby said apertures when aligned are adapted to receive a lock pin therethrough.

16. The improved golf club bag of claim 13, wherein each of said first and second arm members have a surface defining a recess, said recesses in said arm members defining said opening therebetween when said arm members are aligned adjacent one another.

17. The improved golf club bag of claim 16, wherein each of said recesses contain a resilient liner surrounding said opening formed by said recesses when said arm members are aligned adjacent one another.

18. The improved golf club bag of claim 17, wherein each said resilient liner is comprised of nylon.

* * * * *